US007578021B1

(12) United States Patent
Figueroa

(10) Patent No.: US 7,578,021 B1
(45) Date of Patent: Aug. 25, 2009

(54) FOOT AND BACK WASHING APPARATUS AND ASSOCIATED METHOD

(76) Inventor: Victor Figueroa, 51 sherman Pl., Jersey City, NJ (US) 07307

( * ) Notice: Subject to any disclaimer, the term of this patent is extended or adjusted under 35 U.S.C. 154(b) by 25 days.

(21) Appl. No.: 11/904,380

(22) Filed: Sep. 27, 2007

Related U.S. Application Data

(60) Provisional application No. 60/827,114, filed on Sep. 27, 2006.

(51) Int. Cl.
*A47K 7/02* (2006.01)

(52) U.S. Cl. ..... 15/104.92; 15/160; 4/606

(58) Field of Classification Search ..... 15/104.92, 15/105, 160; 134/6; 4/606
See application file for complete search history.

(56) References Cited

U.S. PATENT DOCUMENTS 5,520,618 A * 5/1996 Massiet ..... 601/136
5,575,034 A * 11/1996 Biernacinski et al. ..... 15/217
6,226,811 B1 * 5/2001 Fagan ..... 4/606
6,684,444 B2 * 2/2004 Wheeler et al. ..... 15/110
6,779,218 B1 * 8/2004 Jusinski ..... 15/104.92
7,266,857 B1 * 9/2007 Mezyed ..... 15/104.92
2003/0204927 A1 * 11/2003 Kelly ..... 15/160
2007/0022527 A1 * 2/2007 Russo et al. ..... 4/606

* cited by examiner

*Primary Examiner*—Randall Chin

(57) ABSTRACT

A foot and back washing apparatus includes a base section formed from rigid and non-corrosive material and oppositely faced planar top and bottom surfaces. The apparatus further includes a first plurality of rectilinear bristles directly anchored to the top surface of the base section, a pumice stone directly nested to the base section, and a second plurality of rectilinear bristles intercalated between selected ones of the first plurality of bristles and extending upwardly from the top surface of the base section. The apparatus further includes a mechanism for removably attaching the base section to a support surface such that the base section remains static while the first and second pluralities of bristles are repeatedly engaged by the user body. Such a removably attaching mechanism includes a plurality of suction cups.

5 Claims, 4 Drawing Sheets

FOOT AND BACK WASHING APPARATUS AND ASSOCIATED METHOD

CROSS REFERENCE TO RELATED APPLICATIONS

This application claims the benefit of U.S. Provisional Application No. 60/827,114, filed Sep. 27, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to foot and back washing apparatuses and, more particularly, to a foot and back washing apparatus for removing dead skin cells from a user body.

2. Prior Art

Perhaps nothing is so calming at the end of a hectic day than soaking in a hot bath. Lighting a scented candle, filling the tub with fragrant bath salts and laying back while a current of warm water circulates around the body; spending a few moments of quiet time relaxing in the bathtub can truly refresh the body, mind and spirit. Similarly, standing underneath a cool shower can be revitalizing and invigorating, particularly after an intense workout. Letting the water stream over the body while pulsating jets gently massage the back, neck and shoulders, standing beneath the flowing water of a shower head can be a relaxing experience.

Regardless of whether one is enjoying a long soak in a warm bath, or simply jumping in the shower to freshen up after football practice, the main reason people take a bath or shower is to get clean. Regularly cleansing the body is important in order to achieve optimal health. Everyday, the average person picks up literally millions of microscopic germs and bacteria, simply by shaking hands with coworkers, using public facilities or working outdoors. If left undisturbed, these germs and bacteria can infiltrate the immune system, resulting in colds, flu and other illness.

Additionally, most adults, teens and children alike, perspire throughout the day. Perspiration is the evaporation of sweat through thousands of glands located all over the body. Serving to control body temperature by cooling the skin, perspiration is a natural process that often leaves one feeling uncomfortable, wet and unclean. Taking a shower or bath and scrubbing the body with gentle soaps, shampoos and cleansers helps rid the body of this unclean feeling, as well as washes away unpleasant body odors that result from perspiration and other bodily functions.

Although regularly taking a bath or shower is of utmost importance for healthy hygiene, there are areas of the body that can be difficult to properly clean. In particular, cleaning the feet can be extremely challenging when taking a bath or shower. For example, it can be difficult and awkward for a person to stand on one foot in a shower or bath tub while attempting to maintain one's balance in order to scrub the opposite foot. Because most consumers wear heavy socks or nylons, as well as confining shoes, their feet tend to sweat throughout the day. Over time, this moisture, combined with dirt, debris or even soap residue, can cause germs and bacteria to grow, resulting in feet which smell, or in worse case scenarios, can become infected with athlete's foot, corns and other unsightly and painful maladies. Resulting in the buildup of dry, flaky skin, as well as the aforementioned ailments, neglecting to properly clean the feet can be detrimental to one's overall health.

In addition to the problems associated with cleaning the feet, thoroughly removing dirt and oil from hard to reach areas such as the lower back, spinal column and between the shoulder blades, can be a nearly impossible task. Twisting, turning and stretching the arms in awkward positions, most people simply lack the dexterity and the strength to adequately clean these hard to reach areas of their body. Obviously, it would be advantageous to provide a means for enabling users to thoroughly clean hard to reach areas of their body, in particular, the feet and the back.

U.S. Pat. No. 5,813,078 to Hogan discloses a shower foot washer comprises of a platform having a proximal portion, a distal portion, a top surface and a bottom surface. A casement extends upward from the top surface and along the distal portion of the platform. A plurality of vertical partitions extends through the casement to the top surface of the platform, thus forming segmented portions within the casement. Brush extensions protrude from the vertical partitions to aid in the cleansing of one's foot and toes. A button is positioned on the casement, thus dispensing soap when pressed. A plurality of bores is positioned along the proximal portion of the platform. The bores extend from the top surface of the platform, through the platform, to the bottom surface. These bores allow for water and soap to drain through the shower foot washer. A plurality of suction cups is positioned along the bottom surface of the platform. These suction cups secure the washer to the bottom of a bathtub or shower stall, thus allowing the washer to be removed or conveniently positioned in the stall or tub. Unfortunately, this prior art example is not designed for cleaning other hard-to-reach areas of the body.

U.S. Pat. No. 6,618,870 to Farias discloses a foot washer comprised of a coupler valve capable of attachment to a shower outlet, a main hose coupled with the coupler valve to allow feeding of water from the coupler valve through the main hose, a hollow frame capable of receiving a flow of water from a main hose, and one or more nozzles capable of spraying water from the hollow frame. A user placing a foot near the frame can receive a foot washing. Unfortunately, this prior art example is not designed for cleaning other hard-to-reach areas of the body.

U.S. Pat. No. 4,696,068 to Kenner discloses a back washer and massager supported on a shower wall or bathtub and includes a pad of foam plastic with a waterproof cover and a rigid backing plate supported by a plurality of suction cups with a terry cloth or similar fabric cover mounted on the pad to enable easy removal for laundering and the like. The cover for the pad includes a pocket on the interior surface thereof to receive soap positioned in a net bag so that a person taking a shower or bath can position their back or any other inaccessible area of their body against the surface of the terry cloth or other fabric cover. Moving the body area engaged with the cover provides a washing or massaging function on the surface area of the body. Unfortunately, this prior art example is not designed for cleaning and maintaining a user's feet.

Accordingly, a need remains for a combined foot and back washing apparatus in order to overcome the above-noted shortcomings. The present invention satisfies such a need by providing an apparatus that is convenient and easy to use, is durable yet lightweight in design, is versatile in its applications, and offers users a simple and effective means of thoroughly cleaning hard to reach areas of the body.

BRIEF SUMMARY OF THE INVENTION

In view of the foregoing background, it is therefore an object of the present invention to provide an apparatus for removing dead skin cells from a user body. These and other objects, features, and advantages of the invention are provided by a foot and back washing apparatus.

A foot and back washing apparatus includes a base section effectively formed from rigid and non-corrosive material and oppositely faced planar top and bottom surfaces. The apparatus further includes a first plurality of rectilinear bristles directly anchored to the top surface of the base section and vertically aligned during non-scrubbing procedures. Such a first plurality of bristles is conveniently equidistantly juxtaposed along a major surface area of the top surface of the base section. The first plurality of bristles are coextensively shaped and equidistantly spaced apart along the top surface of the base section.

The apparatus further includes a pumice stone directly nested to the base section and fixedly coupled thereto such that the pumice stone covers a selected region of the bristles. Such a pumice stone advantageously has a convex top side defining an apex medially situated between lateral sides thereof, and further has a bottom wall countersunk beneath the top surface of the base section and positioned adjacent to a sidewall of the base section respectively.

The apparatus further includes a second plurality of rectilinear bristles is effectively intercalated between selected ones of the first plurality of bristles and extends upwardly from the top surface of the base section. Such a second plurality of bristles are conveniently grouped together along a semi-circular pattern and anchored directly to the top surface. The second plurality of bristles is coextensively shaped and terminates at a height above the first plurality of bristles. The second plurality of bristles is also spaced apart from the pumice stone.

The apparatus further includes a mechanism for removably attaching the base section to a support surface such that the base section advantageously remains static while the first and second pluralities of bristles are repeatedly engaged by the user body. Such a removably attaching mechanism includes a plurality of suction cups directly anchored to the bottom surface of the base section and situated subjacent to the first and second pluralities of the bristles. The bottom surface of the base section is effectively provided with a plurality of intersecting channels formed therein. Each of such intersecting channels is suitably sized and shaped for guiding the removably attaching mechanism therealong and between alternate positions across the base section. The removably attaching mechanism is independently and simultaneously biased along the channels as desired by the user.

A method for utilizing a foot and back washing apparatus for removing dead skin cells from a user body includes the steps of: providing a base section including first and second pluralities of bristles and a pumice stone attached thereto; affixing a base section to a vertical support surface such that the first and second pluralities of bristles extend outwardly from the base section and along a horizontal plane; applying a cleansing agent directly to the first and second pluralities of bristles and the pumice stone; rubbing at least one user foot back and forth on the first plurality of bristles to remove dirt and debris; rubbing the at least one user foot back and forth on the pumice stone to remove dry skin and calluses; and rubbing the at least one user foot back and forth on the second plurality of bristles to clean between user toes by removing lint and trace debris therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
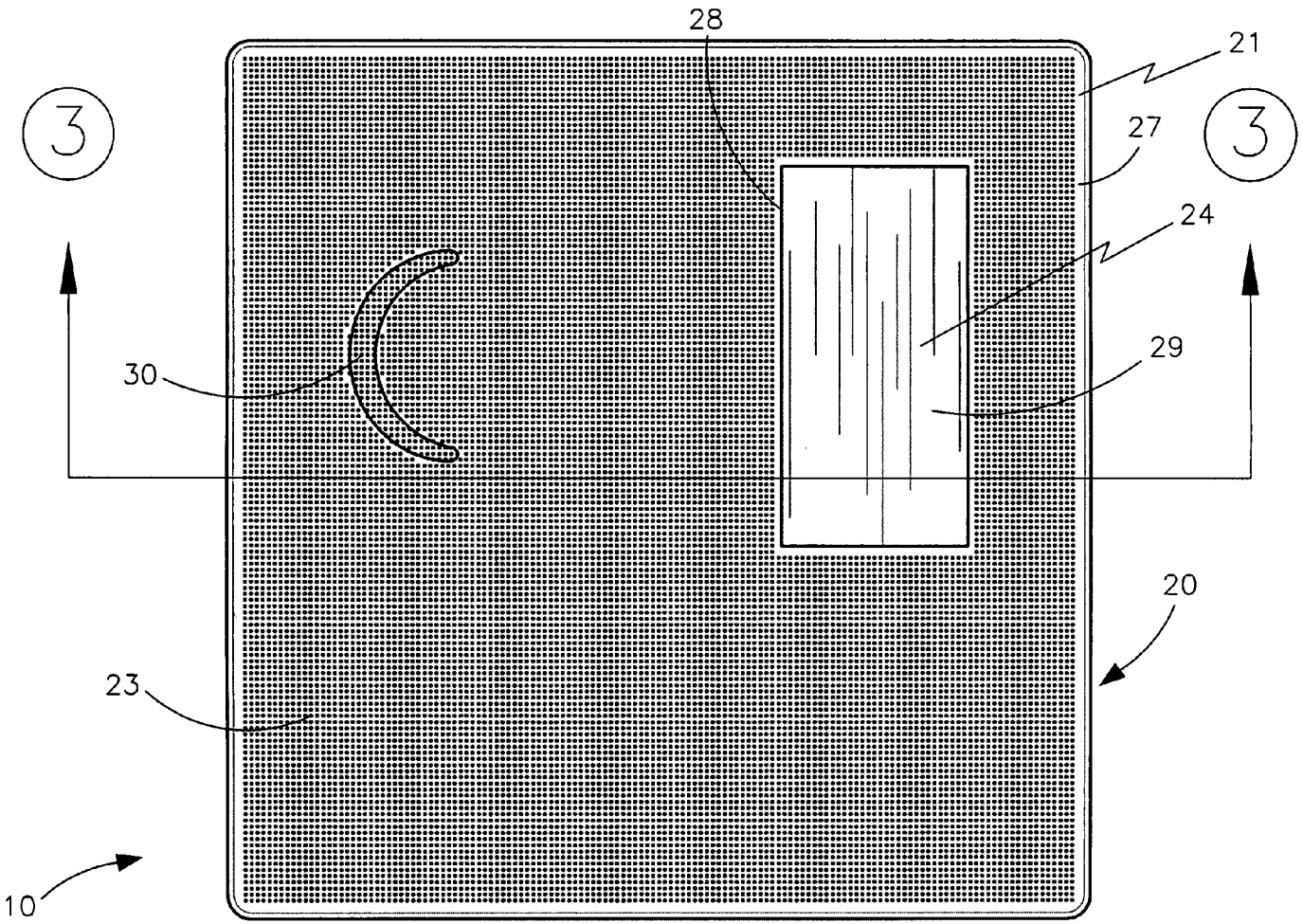
FIG. 1 is a top planar view of a base section, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to protect a foot and back washing apparatus. It should be understood that the apparatus 10 may be used to wash many different types of hard-to-reach body parts and should not be limited to washing only those body parts mentioned herein.

Referring initially to FIGS. 1, 2, 3 and 4, a foot and back washing apparatus 10 includes a base section 20 formed from rigid and non-corrosive material and oppositely faced planar top and bottom surfaces 21, 22. The apparatus 10 further includes a first plurality of rectilinear bristles 23 directly anchored, without the use of intervening elements, to the top surface 21 of the base section 20 and vertically aligned during non-scrubbing procedures. Such a first plurality of bristles 23 is equidistantly juxtaposed along a major surface area of the top surface 21 of the base section 20. The first plurality of bristles 23 are coextensively shaped and equidistantly spaced apart along the top surface 21 of the base section 20. The first plurality of bristles provides a user a surface area of bristles large enough to clean a user back.

Figure 2:
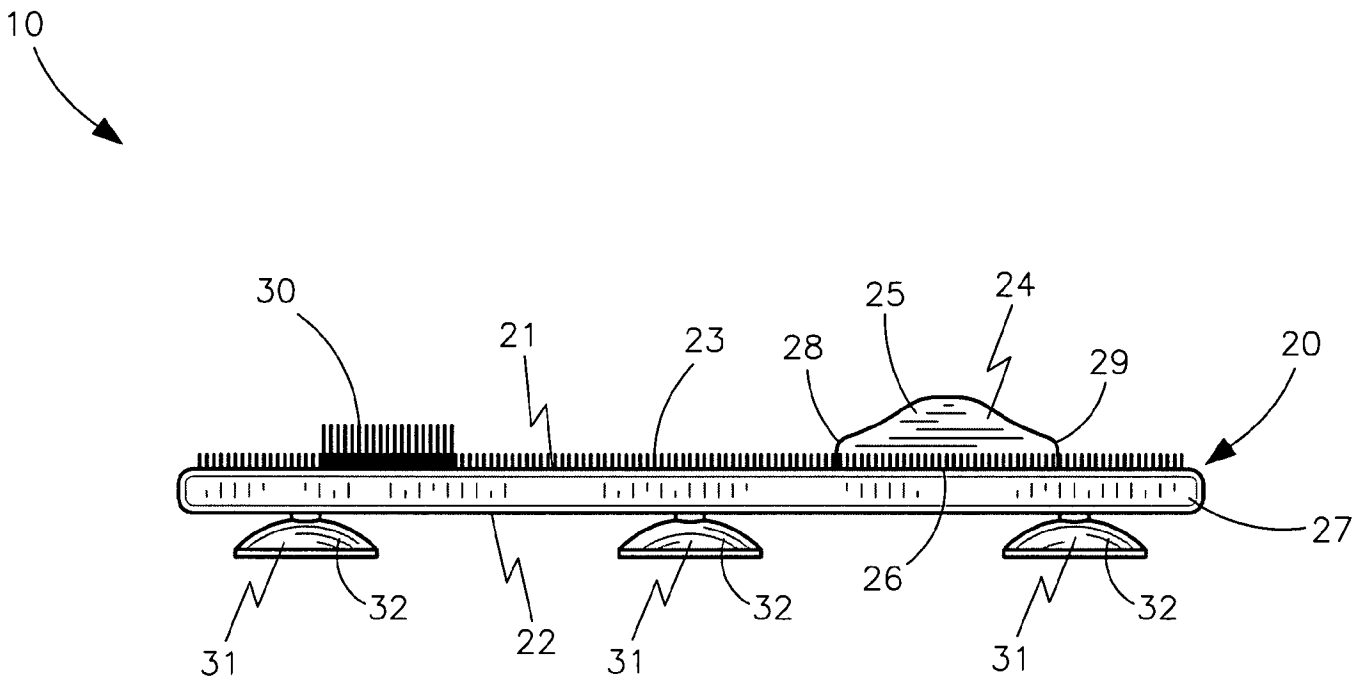
FIG. 2 is a side elevational view of the base section, in accordance with the present invention.
Figure 3:
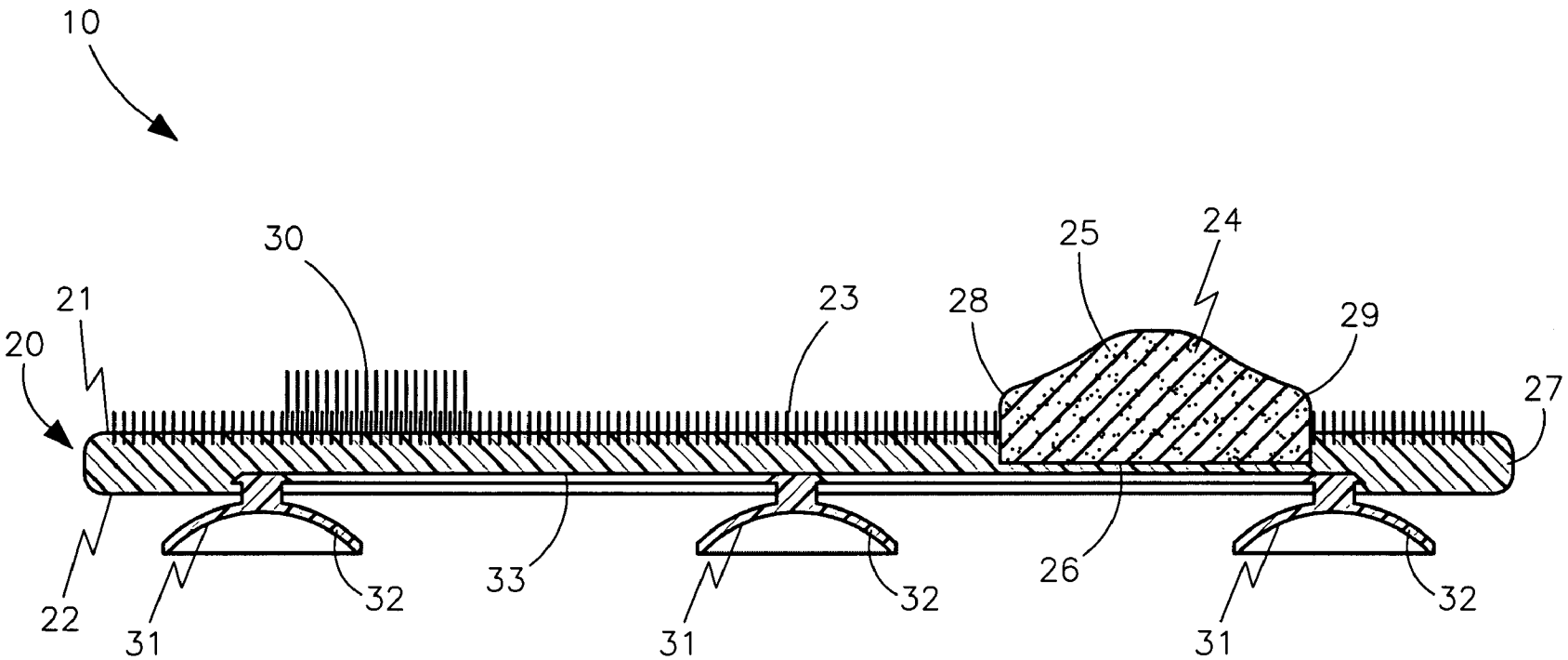
FIG. 3 is a cross sectional view of the present invention, taken along line 3-3, as seen in FIG. 1.

Referring to FIGS. 1, 2 and 3, the apparatus further 10 includes a pumice stone 24 directly nested to the base section 20 and fixedly coupled thereto which is essential such that the pumice stone 24 covers a selected region of the bristles 23. Such a pumice stone 24 has a convex top side 25 defining an apex medially situated between lateral sides 28, 29 thereof, and further has a bottom wall 26 countersunk beneath the top surface 21 of the base section 20 and positioned adjacent to a sidewall 27 of the base section 20 respectively. The pumice stone is used for sloughing dead skin cells and calluses from a user foot.

Referring again to FIGS. 1, 2 and 3, the apparatus 10 further includes a second plurality of rectilinear bristles 30 is intercalated between selected ones of the first plurality of bristles 23 and extends upwardly from the top surface 21 of the base section 20. Such a second plurality of bristles 30 are grouped together along a semi-circular pattern and anchored directly, without the use of intervening elements, to the top surface 21. The second plurality of bristles 30 is coextensively shaped and terminates at a height above the first plurality of bristles 23. The second plurality of bristles 30 is also spaced apart from the pumice stone 24. The second plurality of bristles is provided for thoroughly cleaning a user foot and between the user's toes.

Figure 4:
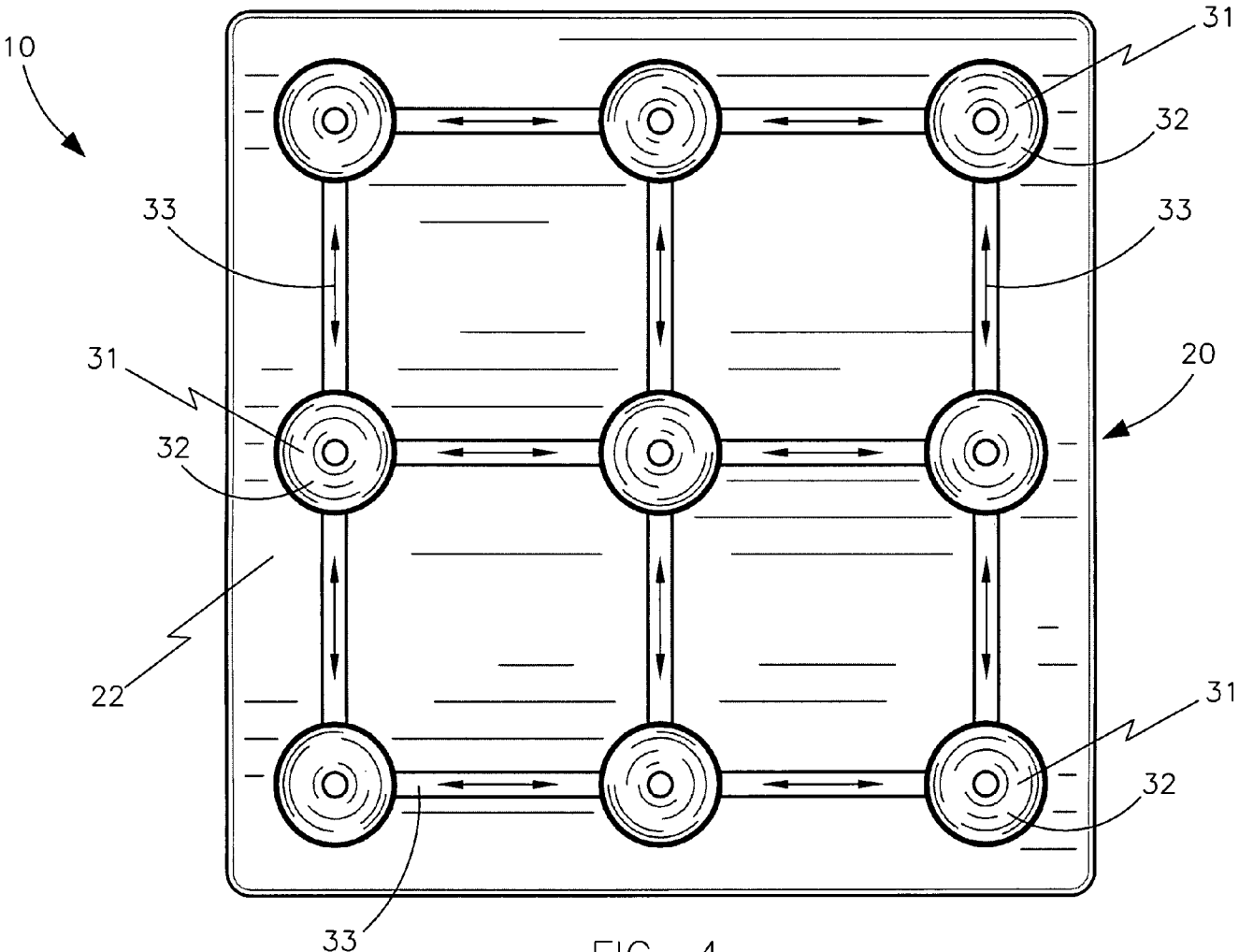
FIG. 4 is a bottom planar view of a base section, in accordance with the present invention.

Referring to FIGS. 2, 3 and 4, the apparatus 10 further includes a mechanism 31 for removably attaching the base section 20 to a support surface which is vital such that the base section 20 remains static while the first and second pluralities of bristles 23, 30 are repeatedly engaged by the user body. Such a removably attaching mechanism 31 includes a plurality of suction cups 32 directly anchored, without the use of intervening elements, to the bottom surface 22 of the base section 20 and situated subjacent to the first and second pluralities of the bristles 23, 30. The bottom surface 22 of the base section 20 is provided with a plurality of intersecting channels 33 formed therein. Each of such intersecting channels 33 is suitably sized and shaped for guiding the removably attaching mechanism 31 therealong and between alternate positions across the base section 20. The removably attaching mechanism 31 is independently and simultaneously biased along the channels 33 as desired by the user. The removably attaching mechanism may be used to attach the apparatus to any planar surface, including but not limited to a bath floor or show sidewall, depending on what body part a user wishes to clean. The channels 33 allow the suction cups 32 to be moved freely about the bottom surface 22 of the base section 20.

In use, the combined foot and back washing apparatus is simple and straightforward to operate. The user simply mounts the apparatus directly to the desired bath tub or shower stall surface. Making sure the desired surface is clean and dry, the user then presses firmly on the apparatus, securing the shell in place via the suction cups. The user then steps into the shower or bathtub, washing their hair, face, neck, arms and legs, per usual. Next, the user cleans those hard to reach areas of their body by utilizing the apparatus. Applying a favorite liquid soap directly to the surface of the mat, the user simply places one or both feet on the mat, rubbing the feet back and forth to remove dirt and debris, while the integrated pumice stone is utilized to remove dry skin and calluses. If desired, the user can utilize the raised contoured bristles to clean between their toes, removing lint and trace debris, with ease.

Once their feet are thoroughly cleaned, the washing apparatus is removed from the floor of the tub or shower and mounted onto the wall. The user then utilizes the apparatus by leaning back against the unit, gently moving their body back and forth to allow the scrubbing surface of the mat to gently scrub away dirt, germs and bacteria from between and over their shoulder blades, the small of their back, their spinal column, as well as the hips and buttocks. After use, the user simply rinses off in the tub or shower, allowing the dirt and soap residue to wash away down the drain. The combined foot and back washing apparatus is then rinsed clean and left in place within the tub or shower, until again needed.

The present invention, as claimed, provides the unexpected and unpredictable benefit of allowing a user to clean any hard-to-reach area of the body with the use of one convenient apparatus. The first plurality of bristles covers an entire top surface 21 of the base section 20, thereby providing a larger area for cleaning the back or other large body parts. In addition, the pumice stone 24 and second plurality of bristles 30 are designed for specifically addressing the cleaning needs of a user. Such benefits overcome the prior art shortcomings.

The present invention is convenient and easy to use, is durable yet lightweight in design, is versatile in its applications, and offers users a simple and effective means of thoroughly cleaning hard to reach areas of the body. Used to clean the feet, the apparatus quickly, easily and gently sloughs away dirt, debris, dry and dead skin cells and even itchy fungus. Because the apparatus so efficiently removes dirt and debris which can cause the growth of bacteria and fungus, use thereof proves an invaluable hygiene tool which can potentially eliminate athletes foot, corns, dry and cracked heals and other ailments which typically occur when feet are not properly cared for.

As a practical alternative to balancing the weight of one's entire body on one foot, simply in order to scrub and clean the opposite foot, the present invention allows users to thoroughly clean their feet while standing upright on both feet. When used to clean the back and similar hard to reach areas, the apparatus gently scrubs away germs and bacteria from the back, shoulders and spinal column, thereby ensuring that even these areas of the body that can be nearly impossible to reach, are clean and fresh. By eliminating the need to bend, twist or stretch the arms in awkward positions, simply in order to properly clean the back, the apparatus offers a comfortable alternative to other methods of cleaning. This advantage proves especially beneficial to those who suffer limited mobility or back pain, ensuring that those who lack the physical dexterity to properly clean themselves can do so easily and efficiently. Although designed with the home user in mind, the apparatus is also well suited for use in spas and athletic clubs. Since it is easy to operate, the apparatus is effectively utilized by most children and adults, regardless of physical shape or conditions. Being durably constructed, the foot and back washing apparatus can withstand years of repeated use.

In use, a method for utilizing a foot and back washing apparatus 10 for removing dead skin cells from a user body includes the steps of: providing a base section 20 including first and second pluralities of bristles 23, 30 and a pumice stone 24 attached thereto; affixing a base section 20 to a vertical support surface such that the first and second pluralities of bristles 23, 30 extend outwardly from the base section 20 and along a horizontal plane; applying a cleansing agent directly to the first and second pluralities of bristles 23, 30 and the pumice stone 24; rubbing at least one user foot back and forth on the first plurality of bristles 23 to remove dirt and debris; rubbing the at least one user foot back and forth on the pumice stone 24 to remove dry skin and calluses; and rubbing the at least one user foot back and forth on the second plurality of bristles 30 to clean between user toes by removing lint and trace debris therefrom.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A foot and back washing apparatus for removing dead skin cells from a user body, said foot and back washing apparatus comprising:

a base section formed from rigid and non-corrosive material and having oppositely faced planar top and bottom surfaces;

a first plurality of rectilinear bristles directly anchored to said top surface of said base section and vertically aligned during non-scrubbing procedures, said first plurality of bristles being equidistantly juxtaposed along a major surface area of said top surface of said base section;

a pumice stone directly nested to said base section and fixedly coupled thereto such that said pumice stone covers a selected region of said bristles;

a second plurality of rectilinear bristles intercalated between selected ones of said first plurality of bristles and extending upwardly from said top surface of said base section; and means for removably attaching said base section to a support surface such that said base section remains static while said first and second pluralities of bristles are repeatedly engaged by the user body;

wherein said pumice stone has a convex top side defining an apex medially situated between lateral sides thereof, said pumice stone having a bottom wall countersunk beneath said top surface of said base section and positioned adjacent to a sidewall of said base section respectively;

wherein said bottom surface of said base section is provided with a plurality of intersecting channels formed therein, each of said intersecting channels being suitably sized and shaped for guiding said removably attaching means therealong and between alternate positions across said base section;

wherein said removably attaching means are independently and simultaneously biased along said channels as desired by the user.

2. The foot and back washing apparatus of claim 1, wherein said first plurality of bristles are coextensively shaped and equidistantly spaced apart along said top surface of said base section.

3. The foot and back washing apparatus of claim 1, wherein said second plurality of bristles are grouped together along a semi-circular pattern and anchored directly to said top surface, said second plurality of bristles being coextensively shaped and terminating at a height above said first plurality of bristles.

4. The foot and back washing apparatus of claim 1, wherein said second plurality of bristles are spaced apart from said pumice stone.

5. The foot and back washing apparatus of claim 1, wherein said removably attaching means comprises: a plurality of suction cups directly anchored to said bottom surface of said base section and situated subjacent to said first and second pluralities of said bristles.

* * * * *